US008356675B2

(12) United States Patent
Pietras et al.

(10) Patent No.: US 8,356,675 B2
(45) Date of Patent: Jan. 22, 2013

(54) APPARATUS AND METHODS FOR TUBULAR MAKEUP INTERLOCK

(75) Inventors: Bernd-Georg Pietras, Wedemark (DE); Egill Abrahamsen, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/852,651

(22) Filed: Aug. 9, 2010

(65) Prior Publication Data

US 2011/0017474 A1 Jan. 27, 2011

Related U.S. Application Data

(63) Continuation of application No. 12/110,176, filed on Apr. 25, 2008, now abandoned.

(60) Provisional application No. 60/926,502, filed on Apr. 27, 2007.

(51) Int. Cl.
*E21B 19/16* (2006.01)
*E21B 19/18* (2006.01)

(52) U.S. Cl. ..... 166/380; 166/77.51; 166/85.1; 175/27; 175/57

(58) Field of Classification Search ..... 175/27, 175/57; 166/380, 77.51, 85.1
See application file for complete search history.

(56) References Cited

U.S. PATENT DOCUMENTS

| | | | | |
|---|---|---|---|---|
| 4,139,891 | A * | 2/1979 | Sheldon et al. | 702/9 |
| 4,269,554 | A | 5/1981 | Jackson | |
| 4,604,724 | A | 8/1986 | Shaginian et al. | |
| 4,621,974 | A * | 11/1986 | Krueger | 414/800 |
| 4,676,312 | A | 6/1987 | Mosing et al. | |
| 5,340,182 | A | 8/1994 | Busink et al. | |
| 5,791,410 | A | 8/1998 | Castille et al. | |
| 5,909,768 | A | 6/1999 | Castille et al. | |
| 6,179,065 | B1 | 1/2001 | Payne et al. | |
| 6,253,849 | B1 | 7/2001 | Newman | |
| 6,626,238 | B2 * | 9/2003 | Hooper | 166/66 |
| 6,691,801 | B2 | 2/2004 | Juhasz et al. | |
| 6,742,596 | B2 | 6/2004 | Haugen | |
| 6,845,825 | B2 | 1/2005 | Bischel et al. | |
| 6,920,931 | B1 | 7/2005 | Webre et al. | |
| 6,938,697 | B2 | 9/2005 | Haugen | |
| 7,073,598 | B2 | 7/2006 | Haugen | |
| 7,086,461 | B2 * | 8/2006 | Schulze-Beckinghausen et al. | 166/77.53 |
| 7,096,977 | B2 | 8/2006 | Juhasz et al. | |
| 7,182,133 | B2 | 2/2007 | Webre et al. | |
| 7,281,587 | B2 | 10/2007 | Haugen | |
| 7,370,707 | B2 | 5/2008 | McDaniel et al. | |
| 7,654,325 | B2 | 2/2010 | Giroux et al. | |
| 7,669,662 | B2 | 3/2010 | Pietras | |

(Continued)

FOREIGN PATENT DOCUMENTS

| | | |
|---|---|---|
| WO | WO 94/04788 | 3/1994 |
| WO | WO 02/092959 | 11/2002 |

OTHER PUBLICATIONS

EP Office Action for Application No. 08 746 970.6-2315 dated Nov. 19, 2010.

(Continued)

*Primary Examiner* — Jennifer H Gay
(74) *Attorney, Agent, or Firm* — Patterson & Sheridan, LLP

(57) ABSTRACT

Apparatus and methods used to prevent an operator from inadvertently dropping a string into a wellbore during assembling and disassembling of tubulars. In one instance, an interlock system is used to control the operations of a gripping apparatus connected to the top drive and a spider such that at least one of the top drive or the spider retains the tubular. The interlock system allows the spider to open when the gripping apparatus is supporting a load of the tubular or is in position to support a load of the tubular.

27 Claims, 8 Drawing Sheets

U.S. PATENT DOCUMENTS

| | | | | |
|---|---|---|---|---|
| 7,686,088 | B2 | 3/2010 | Shahin | |
| 7,717,184 | B2 | 5/2010 | Vold et al. | |
| 8,136,603 | B2 * | 3/2012 | Schneider | 166/380 |
| 2002/0043403 | A1 | 4/2002 | Juhasz et al. | |
| 2002/0170720 | A1 * | 11/2002 | Haugen | 166/379 |
| 2003/0000742 | A1 | 1/2003 | Juhasz et al. | |
| 2003/0106684 | A1 * | 6/2003 | Hooper | 166/64 |
| 2004/0069500 | A1 | 4/2004 | Haugen | |
| 2004/0173358 | A1 | 9/2004 | Haugen | |
| 2004/0188098 | A1 * | 9/2004 | Schulze-Beckinghausen et al. | 166/380 |
| 2004/0216924 | A1 | 11/2004 | Pietras et al. | |
| 2004/0251050 | A1 | 12/2004 | Shahin et al. | |
| 2006/0118293 | A1 | 6/2006 | Juhasz et al. | |
| 2006/0124353 | A1 | 6/2006 | Juhasz et al. | |
| 2006/0169461 | A1 | 8/2006 | Haugen | |
| 2007/0169930 | A1 * | 7/2007 | Shahin et al. | 166/77.52 |
| 2008/0083540 | A1 | 4/2008 | Haugen | |
| 2008/0149326 | A1 * | 6/2008 | Angelle et al. | 166/77.52 |
| 2008/0264648 | A1 | 10/2008 | Pietras et al. | |
| 2009/0151934 | A1 | 6/2009 | Heidecke et al. | |
| 2009/0272542 | A1 * | 11/2009 | Begnaud et al. | 166/380 |
| 2011/0114308 | A1 * | 5/2011 | Nikiforuk et al. | 166/250.01 |
| 2011/0174483 | A1 * | 7/2011 | Odell et al. | 166/250.01 |

OTHER PUBLICATIONS

Canadian Office Action for Application No. 2,685,373 dated Oct. 5, 2011.

* cited by examiner

APPARATUS AND METHODS FOR TUBULAR MAKEUP INTERLOCK

CROSS REFERENCE TO RELATED APPLICATIONS

This application is a continuation of U.S. patent application Ser. No. 12/110,176, filed Apr. 25, 2008, now abandoned which claims benefit to U.S. Provisional Patent Application Ser. No. 60/926,502, filed Apr. 27, 2007, which applications are incorporated herein by reference in their entirety.

BACKGROUND OF THE INVENTION

1. Field of the Invention

The present invention relates to an apparatus and methods for facilitating the connection of tubulars. More particularly, the invention relates to an interlock system for use with two or more tubular holding apparatus during the assembly or disassembly of tubulars. More particularly still, the invention relates to an interlock system for use with a top drive and a spider during the assembly or disassembly of tubulars.

2. Background of the Related Art

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

To drill with casing, most existing top drives use a threaded crossover adapter to connect to the casing. This is because the quill of the top drives is typically not sized to connect with the threads of the casing. The crossover adapter is design to alleviate this problem. Generally, one end of the crossover adapter is designed to connect with the quill, while the other end is designed to connect with the casing. In this respect, the top drive may be adapted to retain a casing using a threaded connection.

However, the process of connecting and disconnecting a casing using a threaded connection is time consuming. For example, each time a new casing is added, the casing string must be disconnected from the crossover adapter. Thereafter, the crossover must be threaded to the new casing before the casing string may be run. Furthermore, the threading process also increases the likelihood of damage to the threads, thereby increasing the potential for downtime.

As an alternative to the threaded connection, top drives may be equipped with tubular gripping heads to facilitate the exchange of wellbore tubulars such as casing or drill pipe. Generally, tubular gripping heads have an adapter for connection to the quill of top drive and gripping members for gripping the wellbore tubular. Tubular gripping heads include an external gripping device such as a torque head or an internal gripping device such as a spear. An exemplary torque head is described in U.S. Patent Application Publication No. 2005/0257933, filed by Pietras on May 20, 2004, which is herein incorporated by reference in its entirety. An exemplary spear is described in U.S. Patent Application Publication Number US 2005/0269105, filed by Pietras on May 13, 2005, which is herein incorporated by reference in its entirety.

During tubular running or makeup/breakout operations, the top drive and the spider must work in tandem, that is, at least one of them must engage the casing string at any given time during casing assembly. Typically, an operator located on the platform controls the top drive and the spider with manually operated levers that control fluid power to the slips that cause the top drive and spider to retain a casing string. At any given time, an operator can inadvertently drop the casing string by moving the wrong lever. Conventional interlocking systems have been developed and used with elevator/spider systems to address this problem, but there remains a need for an interlock system usable with a top drive/spider system such as the one described herein.

There is a need therefore, for an interlock system for use with a top drive and spider to prevent inadvertent release of a tubular string. There is a further need for an interlock system to operate the top drive and the spider based on a load held by the top drive or the spider.

SUMMARY OF THE INVENTION

Embodiments of the present invention generally provide an apparatus and methods to prevent inadvertent release of a tubular or tubular string. In one embodiment, the apparatus and methods disclosed herein ensure that at least one tubular holding device is engaged to the tubular before another tubular holding device is allowed to disengage from the tubular. In another embodiment, either a top drive or a spider is engaged to the tubular before the other component is disengaged from the tubular. The interlock system is utilized with a spider and a top drive during assembly or disassembly of a tubular string.

In yet another embodiment, the interlock system may be used to ensure that at least an elevator or a spider is supporting the tubular during the assembly or disassembly of tubulars.

In one embodiment, an interlock system is used to control the operations of a gripping apparatus connected to the top drive and a spider such that at least one of the top drive or the spider retains the tubular. The interlock system allows the spider to open when the gripping apparatus is supporting a load of the tubular or is in position to support a load of the tubular.

In another embodiment, a method of handling a tubular string using a top drive includes retaining the tubular string using a spider; retaining the tubular string using a tubular gripping apparatus connected to the top drive; determining a string load on the tubular gripping apparatus; and allowing the spider to open or close in response to the determined string load.

In yet another embodiment, an apparatus for handling a tubular includes a tubular handling apparatus; a load compensator coupled to the tubular handling apparatus, wherein the load compensator is movable from a load compensating position to a non-load compensating position; and an interlock system adapted to allow engagement or disengagement of the tubular handling apparatus with the tubular in response to the position of the load compensator.

In yet another embodiment, a method of handling tubulars includes gripping a first tubular using a first gripping apparatus; gripping a second tubular using a second gripping apparatus; connecting the first tubular to the second tubular; moving the first gripping apparatus to a load supporting position; and allowing the second gripping apparatus to release the second tubular when the first gripping apparatus is in the load supporting position.

In yet another embodiment, a method of handling a tubular string using a top drive and a spider includes coupling a load compensator to a tubular gripping apparatus connected to the top drive; retaining the tubular string using the tubular gripping apparatus; determining a string load on the load compensator; and allowing the spider to open or close in response to the determined string load.

In yet another embodiment, a method of handling a tubular using a top drive and a spider includes coupling a load compensator to a tubular gripping apparatus connected to the top drive, wherein the load compensator has a load compensating position and a non-load compensating position; retaining the tubular string using the tubular gripping apparatus; determining the position of the load compensator; and allowing the spider to open or close in response to the position of the load compensator.

In one embodiment, a method of handling a tubular string using a top drive includes retaining the tubular string using a spider; retaining the tubular string using a tubular gripping apparatus connected to the top drive; determining a string load on the tubular gripping apparatus; and allowing opening of the spider to release the tubular string from engagement with the spider when the tubular gripping apparatus is supporting at least a portion of the string load. In another embodiment, the method further includes ensuring a gripping element of the tubular gripping apparatus is engaged with the tubular prior to opening the spider.

In another embodiment, a method of assembling a tubular string using a top drive includes retaining the tubular string using a spider; retaining the tubular string using a tubular gripping apparatus connected to the top drive; determining a string load on the tubular gripping apparatus; and opening the tubular gripping apparatus to release the tubular string from engagement with the tubular gripping apparatus when an absence of string load is determined at the tubular gripping apparatus. In yet another embodiment, the method further includes determining the spider is retaining the tubular string prior to opening the tubular gripping apparatus.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore, not to be considered limiting of its scope, for the invention may admit to other equally effective embodiments.

In FIG. 6, the top drive is shown engaged with the casing string. In FIG. 7, the spider is shown engaged with the casing string.

DETAILED DESCRIPTION OF THE PREFERRED EMBODIMENT

The present invention is an interlock system for use with a top drive and a spider during assembly or disassembly of a string of tubulars. The interlock system may be used to ensure that the tubular string is retained either by the top drive and/or the spider. In one embodiment, the interlock system is adapted to determine that the load of the tubular string is carried by the top drive before the spider is allowed to open.

Figure 1:
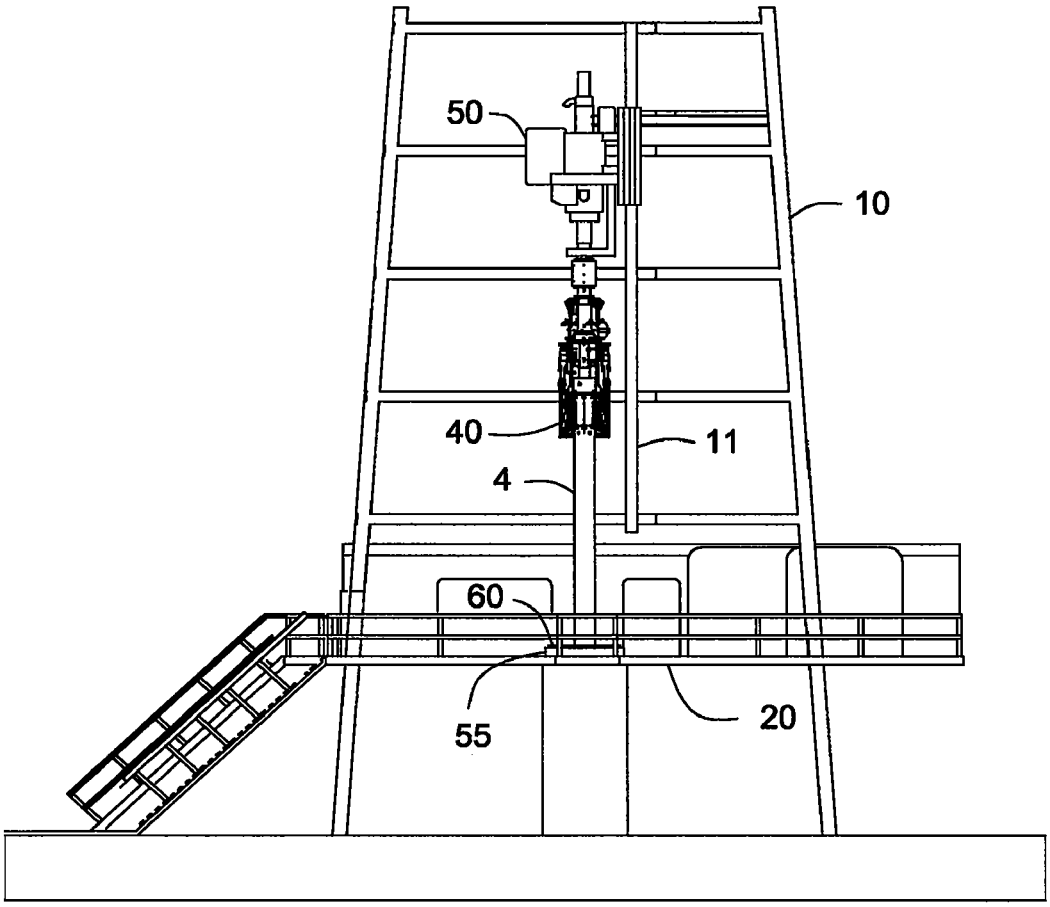
FIG. 1 shows a rig having a top drive and a spider configured to connect tubulars.

FIG. 1 shows a drilling rig 10 applicable to tubular running and drilling operations. The drilling rig 10 includes a rig floor 20 and a hole 55 therethrough, the center of which is termed the well center. A spider 60 is disposed around or within the hole 55 to grippingly engage the tubular 4 at various stages of the drilling operation. As used herein, the tubular 4 may include a single tubular or a tubular string having more than one tubular. Exemplary tubulars include casing, drill pipe, tubing, and other wellbore tubulars as is known to a person of ordinary skill in the art.

The drilling rig 10 includes a top drive 50 positioned above the rig floor 20. A traveling block holds the top drive 50 above the rig floor 20 and may be caused to move the top drive 50 axially. The top drive 50 includes a motor which is used to rotate the casing 4 at various stages of the operation, such as during drilling with casing or while making up or breaking out a casing connection. A railing system 11 is coupled to the top drive 50 to guide the axial movement of the top drive 50 and to prevent the top drive 50 from rotational movement during rotation of the casing 4.

A tubular gripping member is disposed below the top drive 50. The tubular gripping member may include a clamping system such as slips or wedges to grip a tubular. An exemplary tubular gripping member is a torque head 40. The torque head 40 may be utilized to grip an upper portion of the casing 4 and transmit torque from the top drive 50 to the casing 4. An example of a torque head is described in U.S. patent application Ser. No. 10/850,347, filed on May 20, 2004 and published as Publication No. 2005/0157933, which is herein incorporated by reference in its entirety. It must be noted that other types of tubular gripping members such as a spear are also suitable for use with embodiments of the present invention. An exemplary spear type tubular gripping member is disclosed in U.S. Patent Application Publication Number US 2005/0269105, filed by Pietras on May 13, 2005, which is herein incorporated by reference in its entirety.

Figure 2:
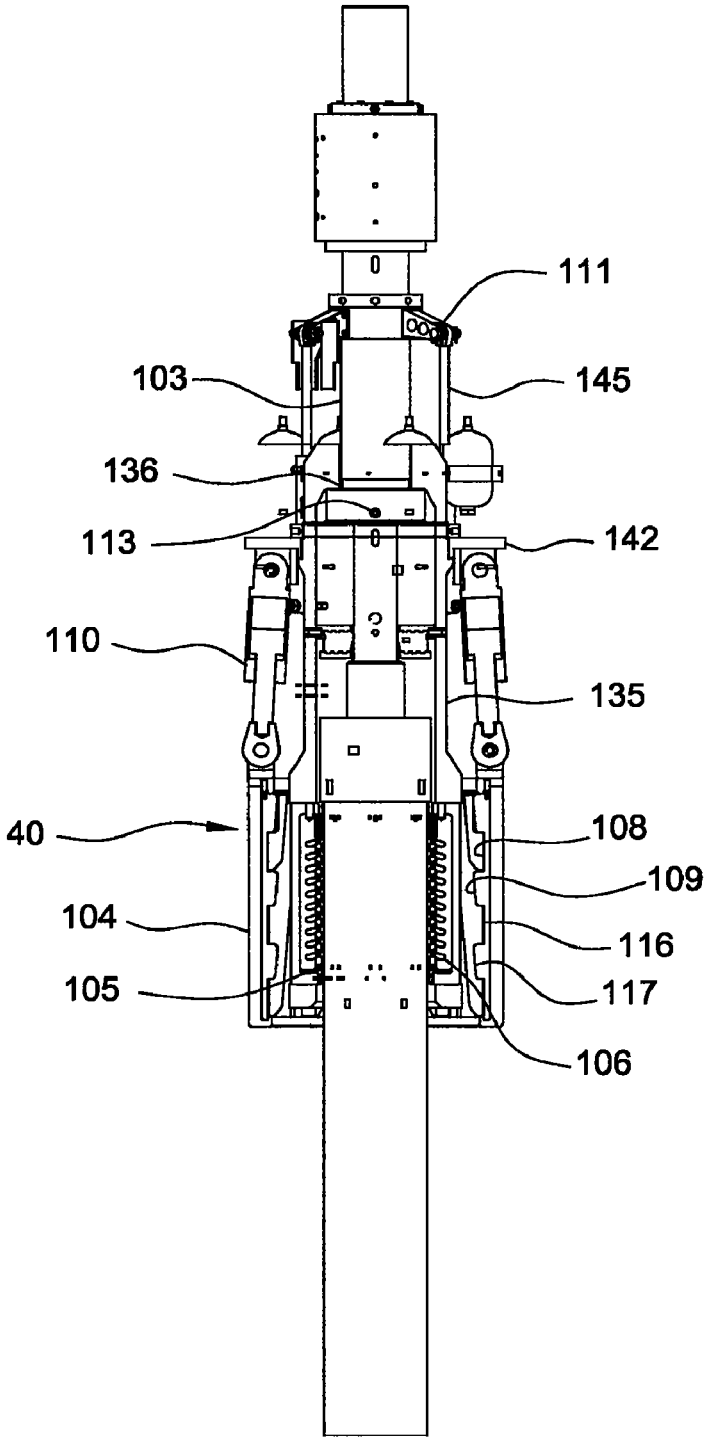
FIG. 2 illustrates a partial cross-sectional view of an exemplary tubular gripping apparatus connectable to the top drive.
Figure 3:
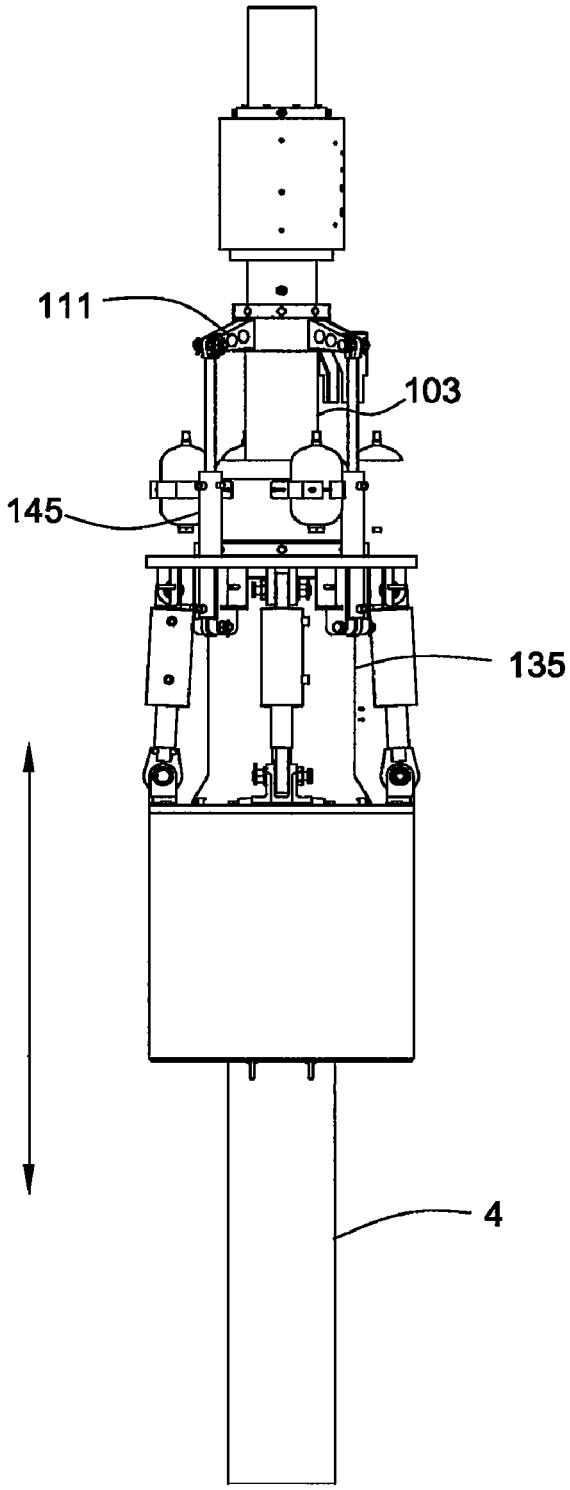
FIG. 3 is a perspective view of the tubular gripping apparatus of FIG. 2.

FIG. 2 is a cross-sectional view of a torque head 40 according to one embodiment of the present invention. FIG. 3 is perspective view of the torque head. In both Figures, the torque head 40 is shown in the extended position. The torque head 40 includes a mandrel 103 for connection with a drive shaft of the top drive 50 and for transmitting torque from the drive shaft to the torque head 40. The mandrel 103 is coupled to an upper end of a tubular body 135 using a spline and groove connection (not shown) or other suitable coupling configuration such as a polygon shaped coupling. The couple connection such as the spline and groove connection allows the body 135 to move axially relative to the mandrel 103 while still allowing torque to be transmitted to rotate the body 135. Additionally, a load shoulder 113 at the lower end of the mandrel 103 is adapted to engage a load shoulder 136 at the upper end of the body 135 when the body 135 is at the lowermost position relative to the mandrel 103. The lower portion of the body 135 includes one or more gripping elements 105, for example, eight gripping elements. The gripping elements 105 may be retained in a window formed in the body 135.

The outer surface of the body 135 includes a flange 142. One or more compensating cylinders 145 connect the flange 142 of the body 135 to the flange 111 of the mandrel 103. In this respect, the compensating cylinders 145 control the axial movement of the body 135 relative to the mandrel 103. The compensating cylinder 145 is particularly useful during makeup or breakout of tubulars. For example, the compensating cylinder 145 may allow the body 135 to move axially to accommodate the change in axial distance between the tubulars as the threads engage or disengage. An exemplary compensating cylinder is a piston and cylinder assembly. The piston and cylinder assembly may be actuated hydraulically, pneumatically, or by any other manner known to a person of ordinary skill in the art.

A housing 104 is disposed around a portion of the exterior of the body 135. The housing 104 is coupled to the flange 142 of the body 135 using a one or more actuating cylinders 110. In this respect, the housing 104 may be raised or lowered relative to the body 135. The interior of the housing 104 includes a key and groove configuration for interfacing with the gripping elements 105. In one embodiment, the key 117 includes an inclined abutment surface, and a groove 116 is disposed between each key 117.

A gripping element 105 is disposed in each of the windows in the body 135. In one embodiment, the gripping element 105 has an exterior surface adapted to interface with the key and groove configuration of the housing 104. Particularly, keys 108 are formed on the exterior surface and grooves 109 are formed between each key 108 to accommodate the key 117 of the housing 104. The keys 108 of the gripping element 105 include an inclined abutment surface adapted to engage the abutment surface of the key 117 of the housing 104. The gripping element 105 abutment surface has an incline complementary to the abutment surface of the housing 104. In one embodiment, a collar may extend from the upper and lower ends of the exterior surface of the gripping elements 105. The collars engage the outer surface of the body 135 to limit the inward radial movement of the gripping elements 105. A biasing member may be disposed between the collar and the body 135 to bias the gripping element 105 away from the body 135. An exemplary biasing member is a spring.

The interior surface of the gripping element 105 includes one or more engagement members 106. In one embodiment, each engagement member 106 is disposed in a slot formed in the interior surface of the gripping element 105. Preferably, the engagement members 106 are pivotable in the slot. The portion of the engagement member 106 disposed in the interior of the slot 115 may be arcuate in shape to facilitate the pivoting motion. The tubular contact surface of the engagement members 106 may be smooth or rough, or have teeth formed thereon. The gripping element 105 may include a retracting mechanism to control movement of the engagement members 106. In one embodiment, the retracting mechanism may be an axially disposed actuating rod adapted to pivot the engagement members 106. It must be noted that other suitable types of clamping mechanisms such as a slip may be used with the tubular gripping member.

In use, the torque head 40 is moved to position the casing 230 inside the body 135. Then, the actuating cylinder 110 is activated to lower the housing 104 relative to the body 135. As the keys 108 of the housing 104 and the keys 117 of the gripping elements 105 come into contact, the gripping element 105 is urged radially into contact with the casing 4, thereby exerting a gripping force on the casing 4. The housing 104 may continue to lower until a sufficient gripping force is applied to retain the casing 4. Additionally, the weight of the casing 4 may force the engagement members 106 to pivot slightly downward, which, in turn, applies an additional radial clamping force to support the casing 4.

Figure 4:
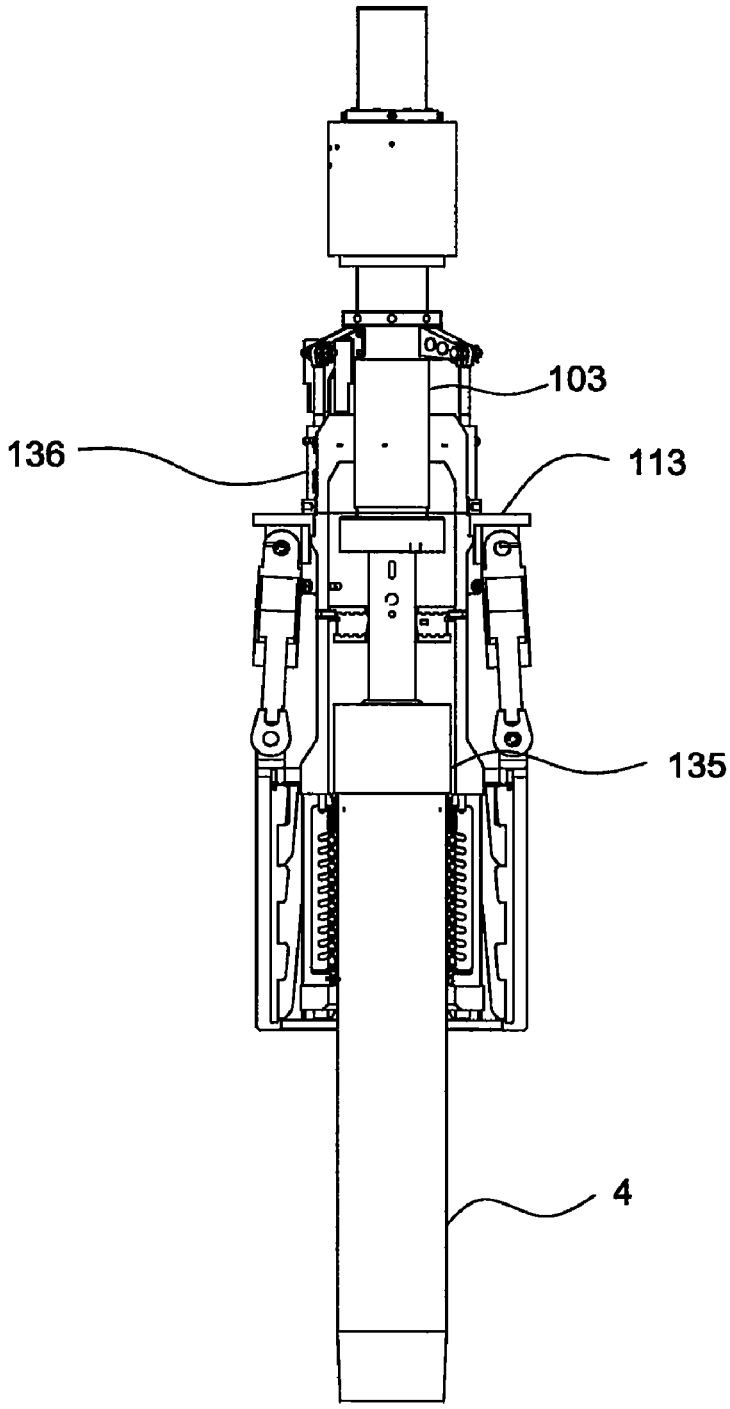
FIG. 4 is another cross-sectional view of the tubular gripping apparatus of FIG. 2.
Figure 5:
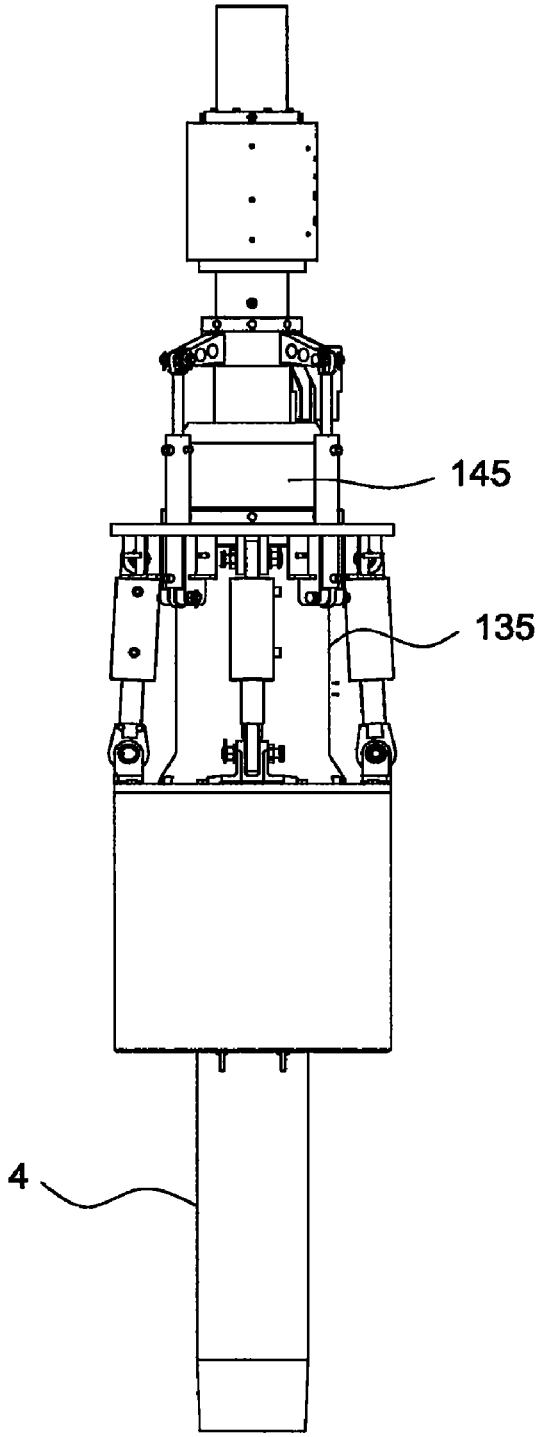
FIG. 5 is another a perspective view of the tubular gripping apparatus of FIG. 2.

To makeup the casing 4 to the casing string, the top drive 50 may be operated to provide torque to rotate the casing 4 relative to the casing string held by the spider 60. During makeup, the compensating cylinder 145 is activated to compensate for the change in axial distance as a result of the threaded engagement, as shown in FIGS. 4 and 5. In this respect, the body 135 is allowed to move axially relative to the mandrel 103 using the spline and groove connection. After the casing 4 is connected to the casing string, the casing string may be released from the spider 60.

After release, the entire casing string load is supported by the torque head 40 and may be rotated or moved axially by the top drive 50. The heavier load of the extended casing string may further pivot the engagement members 106 in the slot of the gripping elements 105. In this respect, the casing string load is distributed among the engagement members 106, thereby allowing the torque head 40 to work as an axial free running drive. Moreover, because the engagement members 106 are all set the same angle, each of the engagement members 106 carries an equal amount of the casing string weight. Additionally, the radial clamping force will be balanced by the housing 104. In one embodiment, when the angle between the key 117 of the housing 104 and the key 108 of the gripping element 105 is less than seven degrees, the radial force will be distributed across the housing 104. In this manner, the torque head may be used to connect tubulars and generally used to perform tubular handling operations.

Figure 6:
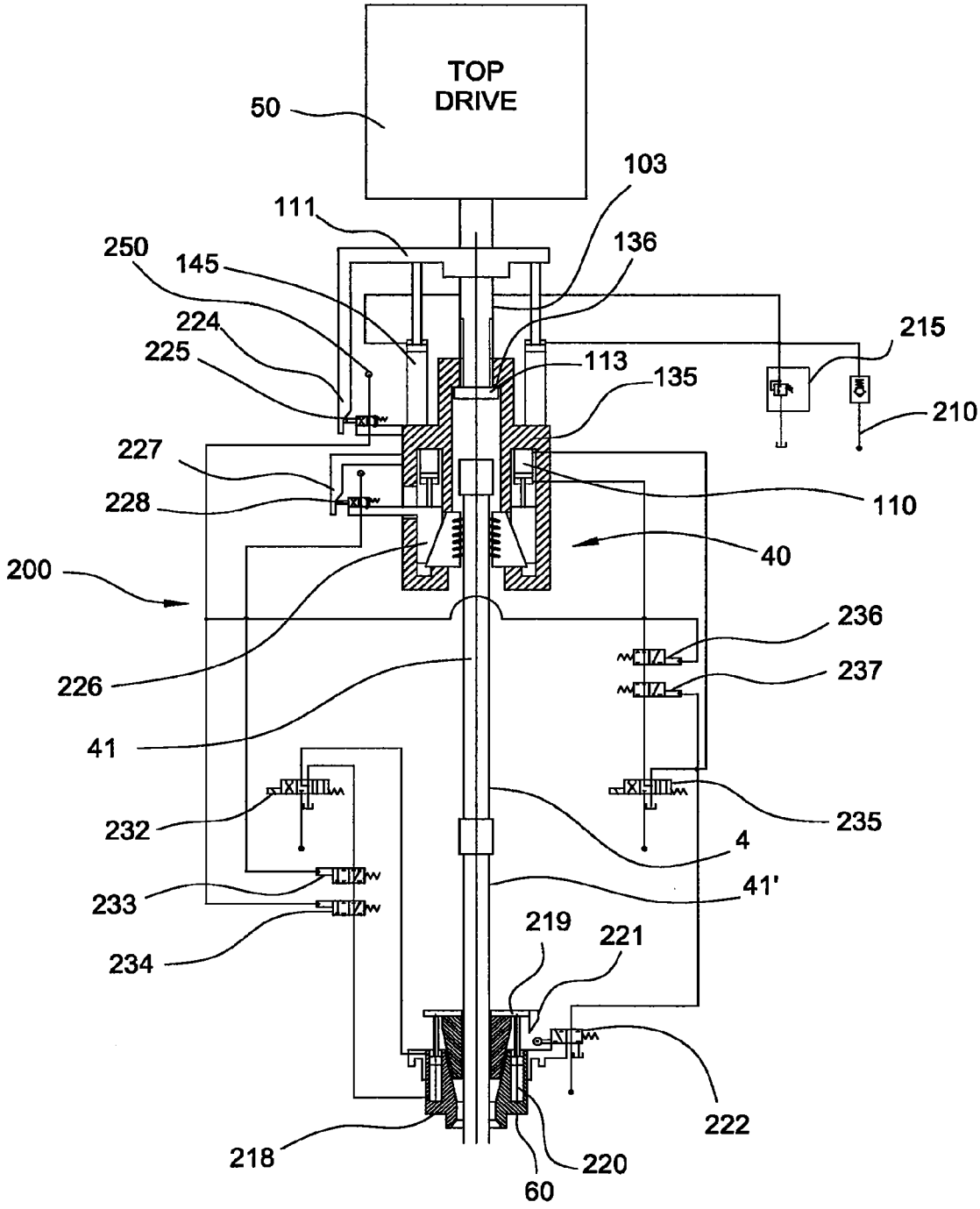
FIGS. 6-7 illustrates a schematic diagram of an exemplary interlock system for use with the top drive and the spider.
Figure 7:
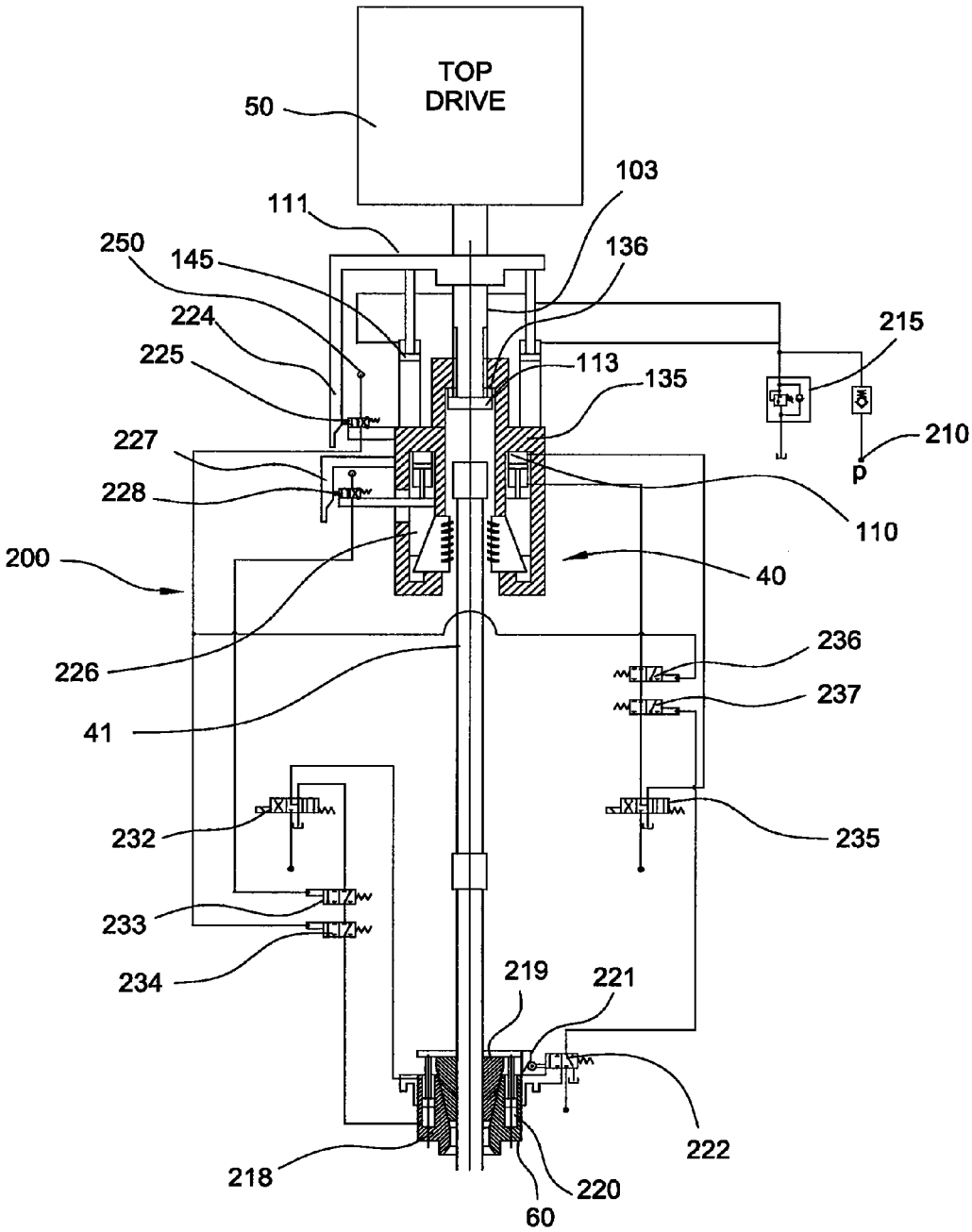

Embodiments of the present invention include an interlock system to ensure that the casing string is retained by either the top drive, via a tubular gripping member, and/or the spider during tubular handling operations. FIGS. 6 and 7 illustrate an exemplary interlock system 200 suitable for use in tubular handling operations. FIGS. 6 and 7 show a spider 60 in cooperation with a top drive 50 coupled with a torque head 40 to retain a casing string 41, which was formed by connecting the casing 4 to the prior casing string 41'. In FIG. 6, the torque head 40 is closed around the casing string 41, and the spider 60 is open. The torque head 40 shown contains many of the same components as the torque head shown in FIG. 2. For clarity purposes, the same reference number will be used to identify the same components.

The torque head 40 in FIG. 6 is shown in the extended position which is indicative of the torque head supporting the load of the casing string 41. In this position, the load shoulder 136 of the body 135 is in contact with the load shoulder 113 of the mandrel 103. It can be seen that the compensating cylinders 145 are also extended. A fluid source 210 supplies the fluid necessary to activate the compensating cylinders 145. The pressure of the fluid is regulated by a pressure regulator 215. The pressure regulator 215 may regulate the pressure of the fluid to the compensating cylinders 145 in order to lift the body 135 relative to the mandrel 103. The gripping elements 105 are shown gripping the casing string 41. The gripping elements 105 are activated by the actuating cylinders 110. The compensating cylinders 145 and the actuating cylinders 110 may be operated on hydraulics, pneumatics, or electrics.

The interlock system 200 includes one or more sensors adapted to determine a load on the torque head. In one embodiment, a load sensor valve 225 coupled to the torque head body 135 is activated by a cam 224 coupled to the flange 111 of the mandrel 103. The cam 224 may have a recess portion that engages the load sensor valve 225 when the compensating cylinder is in the extended position. In this position, the load sensor valve 225 will open to allow a fluid from the control line 250 to pass. Fluid passing through the load sensor valve 225 may act as a load signal to indicate that the body 135 is extended. When the compensating cylinders 145 are retracted, the load sensor valve 225 will engage a non-recessed portion of the cam 224. Engagement with the non-recessed portion will close the load sensor valve 225 to deny passage of the control line fluid.

The interlock system 200 also includes a clamp sensor valve 228 to provide status of the gripping element 105. The clamp sensor valve 228 is connected to a clamp actuator 226 movable by the actuating cylinder 110. In comparison to the embodiment shown in FIG. 2, the clamp sensor valve 228 may alternatively be connected to the housing 104. The clamp sensor valve 228 is engaged to a recessed portion of a cam 227 that is connected to the torque head body 135. In this position, the clamp sensor valve 228 is open to allow fluid from the control line 250 to pass. Fluid passing through the clamp sensor valve 225 may act as a clamp signal to indicate that the gripping element 105 is closed. When the actuating cylinders 110 are retracted, i.e., gripping elements 105 are open, the clamp sensor valve 228 will engage a non-recessed portion of the cam 227. In this respect, the clamp sensor valve 228 is closed to deny passage of the control line fluid.

As shown, the spider 60 includes wedges 219 that are movable in and out of the body 218 of the spider 60. The wedge may be used to retain the casing string 41. The body 218 has an incline surface adapted to urge the wedges 219 radially when they are in the body 218, thereby gripping the casing string 41. One or more actuating cylinders 220 are used to move the wedges 219 in and out of the spider body 218. Operating fluid for the actuating cylinders 220 are supplied from a fluid source and regulated by a spider valve 232. The spider also includes a spider sensor valve 222 connected to the spider body 218. The spider sensor valve is adapted to engage a spider cam 221 connected to the wedges 219 when the wedges are in the body 218, i.e., spider 60 is closed around the casing string 41. As shown in FIG. 7, when the spider is closed 60, the spider sensor valve 222 is closed by the spider cam 221. In this position, fluid from the control line 250 is not allowed to pass through the valve 222. When the wedges 219 are out of the body 218, the valve 222 disengages from the spider cam 221 and opens to allow the control line fluid to pass through.

The interlock system 200 is adapted to allow the spider 60 to open when the torque head 40 is clamped to the casing string 41 and prepared to carry the load of the casing string 41. Fluid passing through the load sensor valve 225 signifies that the clamping cylinders 145 are extended and ready to carry the load. Also, fluid passing through the clamp sensor valve 228 signifies that the gripping elements 105 are clamped against the casing string 41. It must be noted that the act of ensuring that the torque head 40 is clamped may be optionally performed as a safety step to determining that the clamping cylinders 145 are carrying or ready to carry the string load. That is, the interlock system 200 may be adapted to allow the torque head 40 to release the casing string 41 based only on whether the torque head 40 is experiencing a load as indicated by the load sensor valve 225. Thus, if the torque head is carrying a load or prepared to carry a load, the torque head is not allowed to open and the spider is allowed to open. As an optional safety feature, the interlock system may also determine that the spider 60 is clamped to the casing string 41 before allowing opening the torque head 40.

In one embodiment, the operating fluid directed toward the spider 60 passes through a load control valve 234 and a clamp control valve 233 before reaching the spider 60. The load control valve 234 is activated by the load signal from the load sensor valve 225. In this respect, when the load sensor valve 225 is open, the load signal (e.g., control line fluid) opens the load control valve 234 to allow passage of the spider operating fluid. When the load sensor valve 225 is closed, the lack of a load signal closes the load control valve 234 to deny passage of the spider operating fluid. Similarly, clamp control valve 233 is activated by the clamp signal from the clamp sensor valve 228. In this respect, the clamp control valve 233 opens when the clamp sensor valve 228 is open, and the clamp control valve 233 closes when the clamp sensor valve 228 is closed.

To open the spider 60, the spider valve 232 is opened to supply operating fluid to the actuating cylinders 220. However, the operating fluid is allowed to reach the spider 60 only when certain operating conditions are met. First, gripping elements 105 of the torque head 40 must be engaged with the casing string 41. When this occurs, the clamp sensor valve 228 will open such that the control line fluid is allowed to pass through. In turn, the control line fluid opens the clamp control valve 233 for the spider operating fluid. Second, the clamping cylinders 145 must be in the extended position and ready to carry the load of the casing string 41. This will open the load sensor valve 225 such that the control line fluid is allowed to pass through. In turn, the control line fluid opens the load control valve 234 for the spider operating fluid. When both the load control valve 234 and the clamp control valve 233 are open, the operating fluid is free to supply and extend the actuating cylinders 220 to open the spider 60. In this manner, the interlock system act to ensure that the torque head 40 is retaining the casing string 41 before the spider 60 is allowed to open.

To open the torque head 40, the actuating cylinders 110 for the gripping elements 105 must be retracted. The actuating cylinders 110 may be retracted only when the spider 60 has clamped the casing string 41 and the torque head 40 is not experiencing any casing string load. The actuating cylinders 110 are operated by an operating fluid supplied from a fluid source having a clamp valve 235. The fluid path for the operating fluid to open the actuating cylinders 110 is connected to a spider control valve 237 and a second load control valve 236. The spider control valve 237 is activated by the spider sensor valve 222. When the spider sensor valve 222 is open (i.e., spider is open), control line fluid is supplied through the sensor valve 222 to close the spider control valve 237. Similarly, the second load control valve 236 is activated by the load sensor valve 225. When the load sensor valve 225 is open (i.e., torque head is ready to support load), control line fluid is supplied through the sensor valve 225 to close the second load control valve 236. In this respect, the closing of either control valves 236, 237 prevents the torque head 40 from opening. Conversely, when the spider sensor valve 222 is closed (i.e., spider is closed), the spider control valve is switched to the open position. Also, when the load sensor valve is closed (i.e., torque head is at least partially retracted), the second load control valve is switched to the open position. In this respect, both control valves 236, 237 must be opened to allow the operating fluid to be supplied to retract the actuating cylinders 110, thereby enabling the opening of the torque head 40. In this manner, the interlock system act to ensure that the spider 60 is retaining the casing string 41 before the torque head 40 is allowed to open.

In another embodiment, a logic circuit may be used to evaluate the signals from the valves 222, 225, 228 to determine the whether to open or close the spider 60 or the torque head 40. The control signals may be evaluated using hydraulic switching, pneumatic switching, electric circuit, and programmable logic controller. The generation of the control signals may be performed using other types of sensors, for example, pilot valves (hydraulic or pneumatic), electric contact switches, inductive sensors, pressure switches, pressure gauges, length measuring systems at the cylinders or electric load cells in line of the actuating cylinders. For example, the interlock system may use electrical sensors to send electrical signals to a controller to control the opening or closing the tubular gripping apparatus or the spider. When the controller receives signals that indicate the clamping cylinders are extended and supporting a string load, the controller may allow the spider to open. The controller may also determine that the gripping elements of the tubular gripping apparatus are closed around the tubular and taking string load prior to opening the spider. When the controller receives signals that indicate the tubular gripping apparatus is not experiencing any string load, the controller may allow the tubular gripping apparatus to open. The controller may also determine that the spider is closed around the tubular prior to allowing the tubular gripping apparatus to open.

In one embodiment, the controller may include a programmable central processing unit that is operable with a memory, a mass storage device, an input control unit, and a display unit. Additionally, the controller may include well-known support circuits such as power supplies, clocks, cache, input/output circuits and the like. The controller is adapted to receive data from sensors and other devices and adapted to control devices connected thereto. An exemplary controller is a computer.

Figure 8:
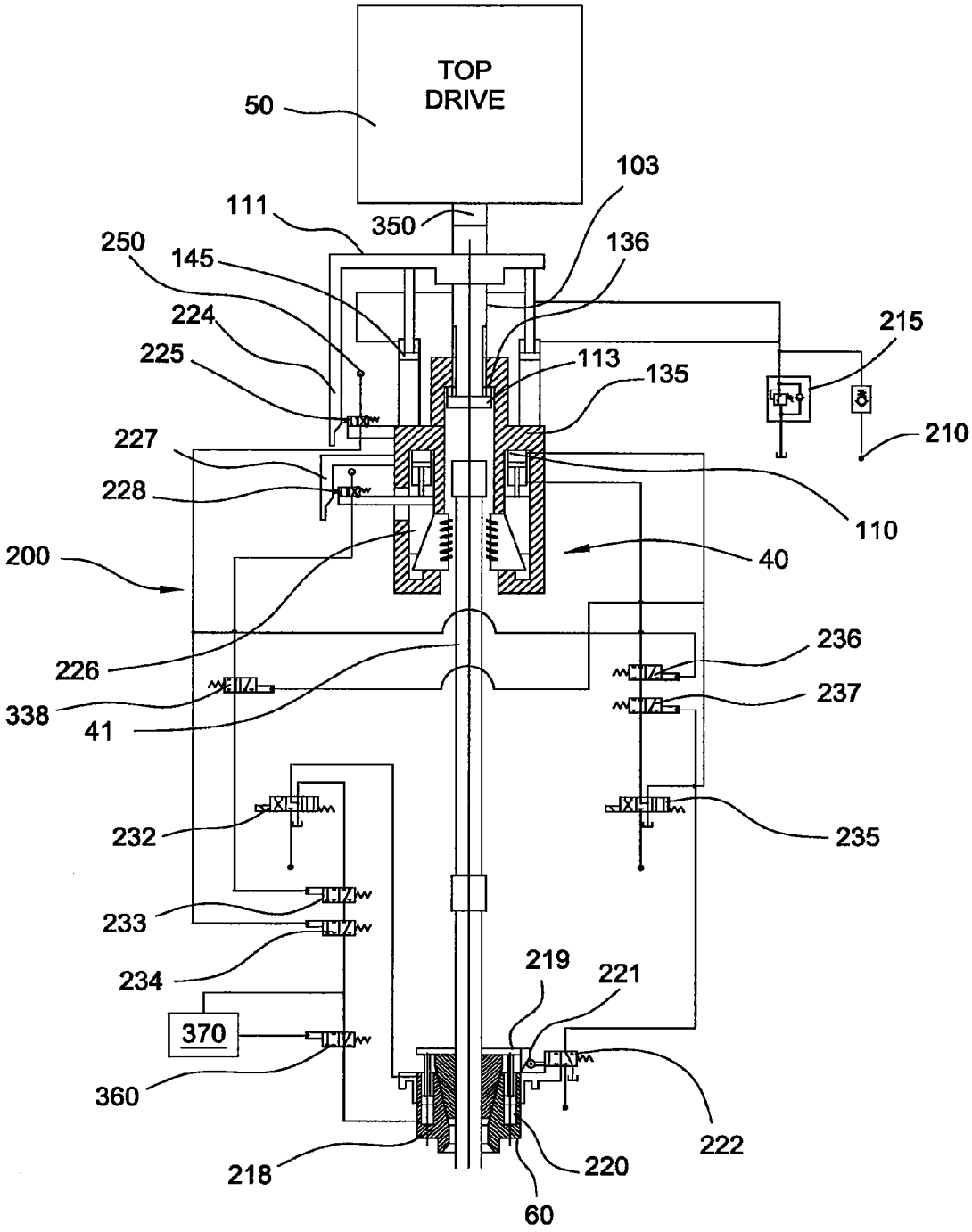
FIG. 8 illustrates another embodiment of an interlock system suitable for use with the top drive and the spider.

FIG. 8 shows another embodiment of the interlock system. In this embodiment, a pressure control valve 338 is used to ensure the torque head 40 is closed around the tubular before allowing the spider 60 to open. The pressure control valve 338 is actuated by the operating fluid supplied to the actuating cylinders 110 for the gripping elements 105. The pressure control valve 338 is positioned in the path of the clamp signal from the clamp sensor valve 228 to the clamp control valve 233. In this respect, when sufficient operating fluid is supplied to the actuating cylinders 110 to apply the proper gripping pressure on the casing, the operating fluid will also open the pressure control valve 338 to allow the clamp signal from the clamp sensor valve 228 to pass. In turn, the clamp signal will open the clamp control valve 233 such that the spider valve 232 may supply operating fluid to the spider 60. On the other hand, when improper gripping pressure is applied due to insufficient operating fluid, the pressure control valve 338 will remained closed to prevent the opening of the clamp control valve 233, and ultimately, the spider 60. In this respect, the position of the gripping elements 105 as well as the gripping pressure applied by the gripping elements 105 are taken into consideration by the interlock system before allowing the spider 60 to open. In effect, the pressure control valve 338 acts as a redundant safety feature for the interlock system. However, it must be noted that the pressure control valve 338 may also replace the clamp sensor valve 228 and the clamp control valve 233 such that opening of the spider 60 depends on the load control valve 234 and the pressure control valve 338.

In yet another embodiment, the load carried by the torque head 40 may be measured using an electric load cell 350. The load cell 350 may be coupled to the mandrel 103 to measure the load on the torque head 40. For example, the load cell 350 may be a component of a torque sub that is used, among other things, to measure torque and load. The torque sub may be connected in line with the mandrel 103 and the top drive 50. An exemplary torque sub is disclosed in U.S. Provisional Patent Application No. 60/866,322, filed on Nov. 17, 2006, by Boutwell, titled "Top Drive Backup Interlock Method," which application is herein incorporated by reference in its entirety. Signal from the load cell 350 may be sent to operate the load control valve 234, thereby eliminating the load sensor valve 225. In use, the measured string load may be compared to a predetermined minimum load before allowing the spider to open. Thus, when the load cell 350 indicates that the torque head is carrying the minimum load, a load signal may be sent to open the load control valve 234. In yet another embodiment, the interlock system may take advantage of the load cell that may already be equipped on the top drive 50. In addition to measuring load on the top drive, the top drive load cell may also send a load signal to the circuit that operates the load control valve 234. In yet another embodiment, the load signal may be sent from a load cell adapted to measure the load carried by the cable supporting the traveling block and the top drive. In yet another embodiment, the load signal may be a hook load as measured by the top drive control system.

In yet another embodiment, the interlock system may include a remote control panel having an acceptance feature that has to be activated before the spider is allowed to open. FIG. 8 shows an exemplary "accept" control valve 360 adapted to control the operating fluid to the spider 60. The accept control valve 360 may be controlled using an "accept" button 370 at the control console. The accept button 370 functions as another safety feature for the interlock system before allowing the spider 60 to open. In this respect, even if a positive load signal and a positive clamp signal are sent to open the load control valve 234 and the clamp control valve 233, the driller may still deny the opening of the spider 60 by not activating the accept control valve 360. Thus, the spider 60 is allowed to open only when all predetermined conditions are met and the driller hits the "accept" button 370. Thereafter, the operator may open the spider 60 by operating a control such as a lever on the control console.

In another embodiment, the interlock system may be operated based on the combinations of one or more the conditions described herein. For example, the interlock system may first require that the torque head is properly clamped on the tubular body and not on the coupling. This determination may be made from the activation of the clamp sensor valve 228. Second, the interlock system may require that the proper clamp pressure is applied to the tubular. This determination may be made from the activation of the pressure control valve 338. Third, the interlock system may require that the weight compensator is fully stroked. This determination may be made from the activation of the load sensor valve 225. Alternatively, this determination may be made using an electric load cell. Fourth, the interlock system may require the operator to move the lever to the "spider open" position. This determination may be made by the operator at the control console. Finally, the interlock system may require the driller to push the "accept" button on the remote control panel. In this manner, the interlock system may be used to ensure that the tubular is retained by at least one of the top drive and the spider. It must be noted that these conditions may be used singularly or in any combination by the interlock system. For example, the interlock system may be set up to require only the torque head is properly clamped and activation of the clamp sensor valve 228 have occurred before allowing the spider to open.

Embodiments of the interlock system may be used in conjunction with the top drive and the spider to prevent the operator from inadvertently dropping the casing string into the wellbore. As disclosed herein, the interlock system ensures that the casing string is at all times either engaged by the top drive or the spider.

In another embodiment, the interlock system may be used in conjunction with an elevator and a spider to ensure at least one of the elevator or the spider is supporting the tubular. The elevator may be connected to the top drive or a tubular gripping mechanism attached to the top drive using a bail or other elongated member. In operation, if the elevator determined to carry a string load, the spider is allowed to open. If no string load is measured at the elevator, the spider is not allowed to open. The string load on the elevator may be determined from measurements made by a load cell, a position of a load compensator, or other methods known to a person of ordinary skill in the art. The elevator may be a equipped with radially movable gripping elements or adapted to support a collar of the tubular, for example, a single joint elevator.

The interlock system may be any interlock system that allows a set of tubular holding devices to disengage only when another set of tubular holding devices is engaged to the tubular. Exemplary tubular holding devices include slips, grapples, collar catching elevators, or other suitable tubular holding devices. The interlock system may be mechanically, electrically, hydraulically, pneumatically actuated systems. The spider may be any spider that functions to hold a tubular or a tubular string at the surface of the wellbore. A top drive may be any system that includes a motor and a tubular gripping member for retaining a tubular by the inner or outer surface and can rotate the retained tubular. The tubular gripping member may include an internal gripping apparatus such as a spear, an external gripping apparatus such as a torque head, or any other tubular gripping member for gripping a tubular as known to a person of ordinary skill in the art. For example, the external gripping apparatus may include a sensor for detecting information from its slips to ensure proper engagement of the casing. The top drive may be hydraulically or pneumatically activated. In yet another embodiment, the interlock system may be used to control the tubular running operation between an elevator supported by a traveling block and the spider. In this respect, the interlock system does not allow the spider to open unless the tubular is supported by the elevator. An exemplary interlock system is disclosed in U.S. patent application Ser. No. 11/393,311, filed on Mar. 30, 2006, by Haugen, which application is assigned to the same assignee as the present invention and is herein incorporated by reference in its entirety.

In yet another embodiment, the tubular may be connected directly to the quill or other gripping device connected to the top drive, and the interlock system is used to allow the release of the tubular from the quill or the spider. Exemplary tubulars include a drill pipe and a casing that is connected to the quill using a crossover. In use, a tubular section may initially be connected to the quill. Then, the tubular section may be rotated by the top drive to connect the tubular string retained by the spider. After connection, the top drive is lifted to carry the load of the newly extended tubular string. The load is measured and compared to a predetermined minimum load before the spider is allowed to open. In this manner, the interlock system prevents the inadvertent release of the tubular from the top drive or the spider during the assembly or disassembly of tubulars.

In addition to casing, embodiments of the present invention are equally suited to handle tubulars such as drill pipe, tubing, and other types of tubulars known to a person of ordinary skill in the art. Additionally, the interlock system may be used for making up or breaking out tubulars that uses a non-rotational type connection mechanism, that is, a non-threaded connection. Moreover, the tubular handling operations contemplated herein may include connection and disconnection of tubulars as well as running in or pulling out tubulars from the well.

While the foregoing is directed to the preferred embodiment of the present invention, other and further embodiments of the invention may be devised without departing from the basic scope thereof, and the scope thereof is determined by the claims that follow.

We claim:

1. A method of handling a tubular string using a top drive, comprising:

retaining the tubular string using a spider;

retaining the tubular string using a tubular gripping apparatus connected to the top drive, wherein the tubular gripping apparatus includes at least one gripping element actuated by at least one actuating cylinder;

determining a string load on the tubular gripping apparatus;

determining a position of the gripping element relative to a tubular retaining position and a tubular releasing position of the gripping element;

determining a gripping pressure applied by the at least one actuating cylinder; and allowing the tubular gripping apparatus to open or close in response to the determined string load, the position of the gripping element, and the gripping pressure.

2. The method of claim 1, further comprising ensuring the gripping element is in the tubular retaining position prior to opening the spider.

3. The method of claim 1, wherein the determining a string load comprises measuring the string load using a load measuring device.

4. The method of claim 1, further comprising determining a position of a compensating actuator supporting the tubular gripping apparatus.

5. The method of claim 4, wherein the compensating actuator is extended when the tubular gripping apparatus is supporting the string load.

6. The method of claim 1, further comprising opening the spider when the string load is detected.

7. The method of claim 6, further comprising lowering the tubular string and re-gripping the tubular string using the spider.

8. The method of claim 1, further comprising maintaining the spider in a closed position when no load is detected.

9. The method of claim 1, further comprising allowing the tubular gripping apparatus to open when no string load is detected at the tubular gripping apparatus.

10. The method of claim 1, wherein the tubular gripping apparatus is selected from the group consisting of external tubular gripping apparatus, internal tubular gripping apparatus, and elevator.

11. The method of claim 1, wherein allowing the tubular gripping apparatus to open or close in response to the determined string load, the position of the gripping element, and the gripping pressure comprises applying a gripping pressure sufficient to grip the casing to open a pressure control valve.

12. An apparatus for handling a tubular, comprising:

a tubular handling apparatus having at least one gripping element actuated by at least one actuating cylinder;

a clamp sensor for determining a position of the at least one gripping element;

a pressure control valve actuated by a gripping pressure applied by the at least one actuating cylinder;

a compensator coupled to the tubular handling apparatus, wherein the compensator is movable from a load supporting position to a non-load supporting position; and an interlock system adapted to allow engagement or disengagement of the tubular handling apparatus with the tubular in response to the position of the compensator, the position of the at least one gripping element, and the gripping pressure applied.

13. The apparatus of claim 12, wherein the tubular handling apparatus is engaged with the tubular when the compensator is at the load supporting position.

14. The apparatus of claim 13, wherein the compensator comprises a piston and cylinder assembly.

15. The apparatus of claim 14, wherein the piston and cylinder assembly is at least partially retracted when in the load supporting position.

16. The apparatus of claim 12, wherein the pressure control valve is opened when a gripping pressure sufficient to grip the casing is applied.

17. The apparatus of claim 16, wherein the pressure control valve allows communication of a signal from the clamp when the pressure control valve is open.

18. A method of handling tubulars, comprising:

gripping a first tubular using a first gripping apparatus;

gripping a second tubular using a second gripping apparatus;

connecting the first tubular to the second tubular;

moving the first gripping apparatus to a load supporting position;

determining a gripping element of the first gripping apparatus is engaged with the first tubular;

determining a sufficient gripping pressure is being applied by the gripping element; and allowing the second gripping apparatus to release the second tubular and preventing the first gripping apparatus from opening when the first gripping apparatus is in the load supporting position, is in the engaged position, and is applying the sufficient gripping pressure.

19. The method of claim 18, wherein the first tubular includes a collar and a body.

20. The method of claim 18, further comprising activating an acceptance feature before opening the second gripping apparatus.

21. The method of claim 18, wherein allowing the second gripping apparatus to release the second tubular and preventing the first gripping apparatus from opening when the first gripping apparatus is in the load supporting position, is in the engaged position, and is applying the sufficient gripping pressure comprises applying a gripping pressure sufficient to grip the casing to open a pressure control valve.

22. A method of handling a tubular string using a top drive and a spider, comprising:

coupling a compensator to a tubular gripping apparatus connected to the top drive;

retaining the tubular string using the tubular gripping apparatus, wherein the tubular gripping apparatus includes at least one gripping element actuated by at least one actuating cylinder;

determining a string load on the compensator;

determining a position of the gripping element relative to the gripping element's open and closed positions;

determining a gripping pressure applied by the at least one actuating cylinder; and allowing the tubular gripping apparatus to open or close in response to the determined string load, the determined position, and the determined gripping pressure.

23. The method of claim 22, wherein the tubular gripping apparatus is allowed to open when the compensator is not supporting a load.

24. The method of claim 22, wherein the spider is allowed to open when the compensator is supporting a load.

25. The method of claim 22, wherein the compensator has a load compensating position and a non-load compensating position, wherein the tubular gripping apparatus is allowed to open only if the compensator is in the non-load compensating position.

26. The method of claim 25, wherein the compensator comprises a piston and cylinder assembly.

27. The method of claim 22, allowing the tubular gripping apparatus to open or close in response to the determined string load, the determined position, and the determined gripping pressure comprises applying a gripping pressure sufficient to grip the casing to open a pressure control valve.

* * * * *